US008561440B1

(12) United States Patent
Sierra

(10) Patent No.: US 8,561,440 B1
(45) Date of Patent: Oct. 22, 2013

(54) PIVOTED COVER LOCK

(76) Inventor: Rafael Sierra, Long Beach, CA (US)

( * ) Notice: Subject to any disclaimer, the term of this patent is extended or adjusted under 35 U.S.C. 154(b) by 0 days.

(21) Appl. No.: 13/453,943

(22) Filed: Apr. 23, 2012

(51) Int. Cl.
*E05B 65/06* (2006.01)

(52) U.S. Cl.
USPC ..... 70/129; 70/56; 70/417; 292/57; 292/148

(58) Field of Classification Search
USPC ..... 70/56, 129, 417; 292/57, 148
See application file for complete search history.

(56) References Cited

U.S. PATENT DOCUMENTS 875,087 A * 12/1907 Mackintosh ..... 292/57
1,593,684 A * 7/1926 Anakin ..... 70/128
2,631,877 A * 3/1953 Ainsworth ..... 292/57
2,656,704 A * 10/1953 Mancuso ..... 70/128
3,563,069 A * 2/1971 Ferrer ..... 70/129
3,953,062 A 4/1976 Maston
4,031,719 A 6/1977 Klingler et al.
4,068,505 A * 1/1978 Volk, Jr. ..... 70/56
4,229,956 A * 10/1980 Thorburn ..... 70/129
4,437,692 A 3/1984 Halopoff
4,438,641 A * 3/1984 Levkov ..... 70/95
4,616,493 A * 10/1986 Fazzolari et al. ..... 70/129
4,655,487 A 4/1987 Korn et al.
4,690,441 A * 9/1987 Fazzolari et al. ..... 292/57
4,782,675 A * 11/1988 Thorburn ..... 70/129
4,798,065 A * 1/1989 DeForrest, Sr. ..... 70/129
4,802,351 A * 2/1989 Kojak ..... 70/56
4,877,275 A 10/1989 DeForrest, Sr.
4,972,689 A * 11/1990 Anderson ..... 70/56
5,307,653 A 5/1994 Davis
5,404,734 A * 4/1995 Martinez ..... 70/34
5,444,998 A * 8/1995 James ..... 70/14
5,868,015 A * 2/1999 Eaker ..... 70/129
5,931,032 A * 8/1999 Gregory ..... 70/129
6,351,975 B1 * 3/2002 Valdes ..... 70/56
6,477,872 B1 * 11/2002 Denton, Jr. ..... 70/129
6,708,532 B2 * 3/2004 Winland ..... 70/2
6,848,284 B2 * 2/2005 Chen ..... 70/56
7,146,830 B2 * 12/2006 Huang ..... 70/25
2005/0061041 A1 * 3/2005 Rosenberg et al. ..... 70/129
2005/0160775 A1 * 7/2005 Evans ..... 70/129

* cited by examiner

*Primary Examiner* — Suzanne Barrett
(74) *Attorney, Agent, or Firm* — QuickPatents; Kevin Prince

(57) ABSTRACT

A slide bolt lock for locking a pivoting garage door to a garage door frame includes a backing plate has a door mount adapted to fix the backing plate to the door. The backing plate includes a pair of opposed risers, each of which has an aperture therein. The backing plate further includes a lock socket. A rigid slide bolt is slidably and pivotally captured within the apertures of each riser and further includes fixed thereto a lock cover. The slide bolt and the lock cover are slidable between an extended position and a retracted position. The lock cover includes a lock mechanism adapted to selectively and lockingly engage the lock socket of the backing plate when the slide bolt is in the extended position, wherein the lock cover substantially covers the backing plate.

16 Claims, 5 Drawing Sheets

PIVOTED COVER LOCK

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to locks, and more particularly to a slide lock.

DISCUSSION OF RELATED ART

Conventional pivoting garage doors are typically locked to a garage door frame by a slide bolt lock adapted to engage a slide bolt aperture in the frame. With such conventional slide bolt locks, mechanical fasteners that secure the lock to the door are exposed and are typically locked in place with a conventional padlock, which is also exposed and subject to cutting, thereby again defeating the lock.

U.S. Pat. No. 3,953,062 to Maston on Apr. 27, 1976 teaches a slide bolt lock having a cover fixed with the slide bolt for covering a padlock. Such a device, however, is difficult to use since the padlock cannot be pivoted up to allow for easily inserting the key, and instead requires the key to be inserted in the bottom of the padlock in an awkward fashion. Further, the padlock bolt is somewhat exposed and, as such, is susceptible to vandalism. Still further, such a device requires the use of a separate padlock, which can be misplaced when unlocked. U.S. Pat. No. 4,031,719 to Klingler et al. on Jun. 28, 1977, U.S. Pat. No. 4,437,692 to Halopoff on Mar. 20, 1984, and U.S. Pat. No. 4,655,487 to Korn et al. on Apr. 7, 1987, all teach devices with many of the same drawbacks.

U.S. Pat. No. 5,307,653 to Davis on May 3, 1994, teaches a slide bolt lock having a pivotal cover that covers a lock mechanism that is built into the cover (FIG. 1). Such a locking cover covers an additional padlock, which results in the need for two keys to be used to unlock the slide bolt from the garage door frame. Further, the padlock is still accessible from the open side.

Therefore, there is a need for a lock that, when engaged, substantially covers both the lock mechanism and the mechanical fasteners holding the lock to the door. Such a needed device would be relatively inexpensive to manufacture, and would not require a separate locking mechanism such as a padlock. Further, such a needed invention would be strong to resist cutting and would provide other vandalism-defeating measures. Further, such a needed device would only require a single key, and the keyhole for such a key would be easily accessible. The present invention accomplishes these objectives.

SUMMARY OF THE INVENTION

The present device is a slide bolt lock for locking a pivoting garage door to a garage door frame, a residential front door to a door frame, or the like. A rigid backing plate has a door mount adapted to fix the backing plate to the door, such as with a bolt or other mechanical fastener. The backing plate preferably includes a pair of opposed risers, each of which has an aperture therein. The backing plate further includes a lock socket.

A rigid slide bolt is slidably and pivotally captured within the apertures of each riser and further includes fixed thereto a lock cover. The slide bolt and the lock cover are slidable between an extended position and a retracted position. The lock cover includes a lock mechanism adapted to selectively and lockingly engage the lock socket of the backing plate when the slide bolt is in the extended position, wherein the lock cover substantially covers the backing plate. In one embodiment, the lock mechanism is a key lock mechanism.

In one embodiment, the lock cover is fixed to the slide bolt with a locking plate bracket adapted to fixedly receive the slide bolt therein. The slide bolt may be welded or otherwise permanently fixed with each riser of the locking plate bracket.

In use, with the slide bolt in the retracted position the door is free to swing clear of the frame, and with the slide bolt in the extended position and engaged with a slide bolt aperture of the frame, the lock cover may be pivoted so that the lock mechanism engages the lock socket to lock the door to the frame.

In one embodiment, a bushing is rotationally fixed about the slide bolt, the bushing being positioned between the frame and the backing plate when the slide bolt is in the extended position and engaged with the frame. As such, force applied to the bushing, such as by a cutting blade or the like, causes the bushing to rotate about the slide bolt, inhibiting the slide bolt from being cut or otherwise vandalized.

The present invention is a slide bolt lock that, when engaged, substantially covers both the lock mechanism and any mechanical fasteners holding the lock to the door. The present device is relatively inexpensive to manufacture, and does not require a separate locking mechanism such as a padlock. Further, the present invention is strong so as to resist cutting and provides other vandalism-defeating measures. Further, the present device only requires a single key, and the keyhole for such a key is easily accessible. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 3:
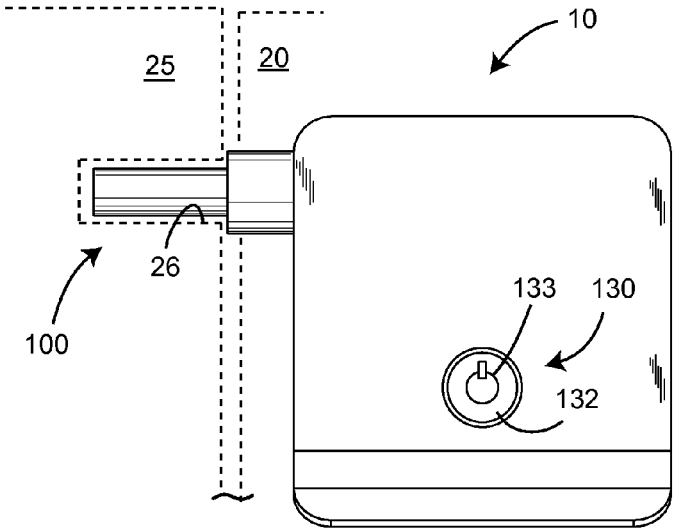
FIG. 3 is a front elevational view of FIG. 1.
Figure 2:
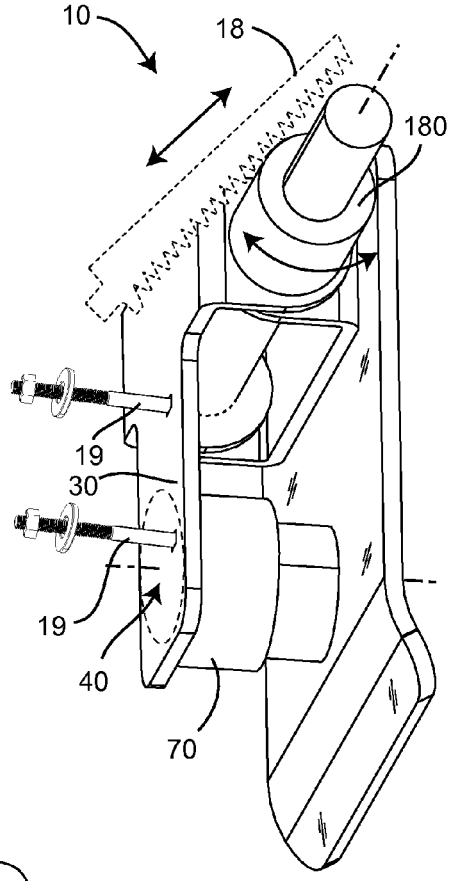
FIG. 2 is a rear perspective view of FIG. 1.
Figure 1:
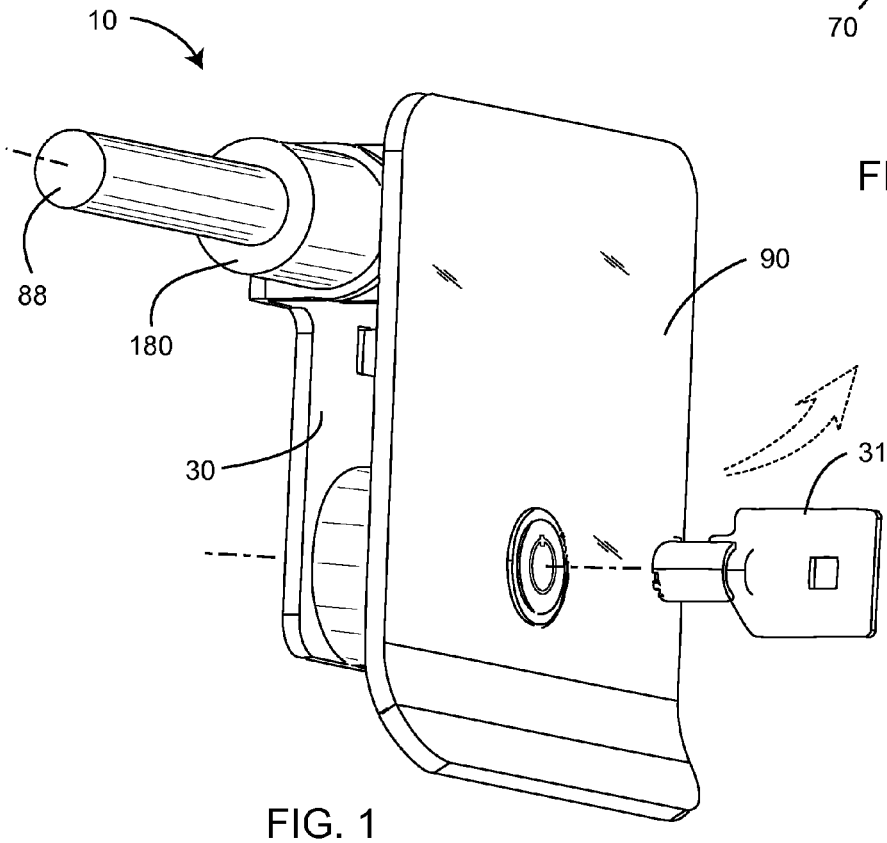
FIG. 1 is a front perspective view of a first embodiment of the invention, illustrated in a locked position.

FIGS. 1-3 and 7 illustrate a slide bolt lock 10 for locking a door 20 to a frame 25. Such a frame 25 has a slide bolt aperture 26 (FIG. 3). Such a door 20 may be a pivoting garage door, for example, conventionally locked by a prior art slide bolt lock (not shown).

Figure 5:
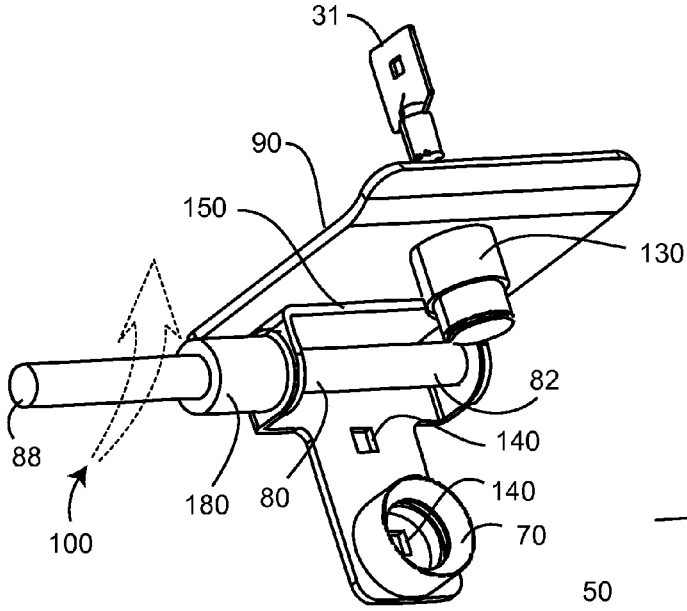
FIG. 5 is an alternate front perspective view of FIG. 4.

A rigid backing plate 30 has a door mount 40 adapted to fix the backing plate 30 to the door 20. Such a door mount 40 may be a pair of backing plate apertures 140 (FIG. 5), a mechanical fastener 19 (FIG. 2) such as a threaded screw or bolt being insertable therethrough to secure the backing plate 30 to the door 20. The backing plate 30 may be made from a rigid steel or other suitably strong material.

Figure 4:
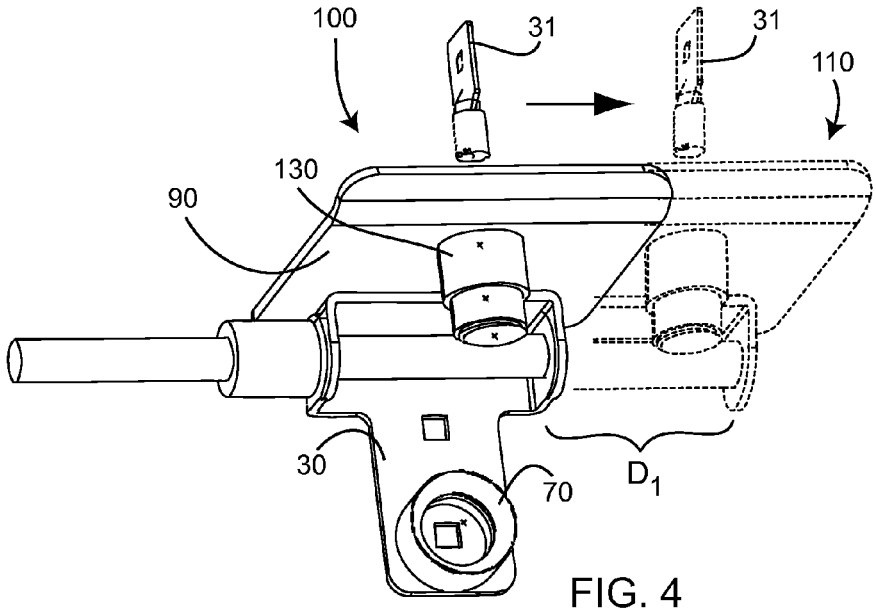
FIG. 4 is a perspective view of the embodiment of FIG. 1 in an open and extended position.
Figure 10:
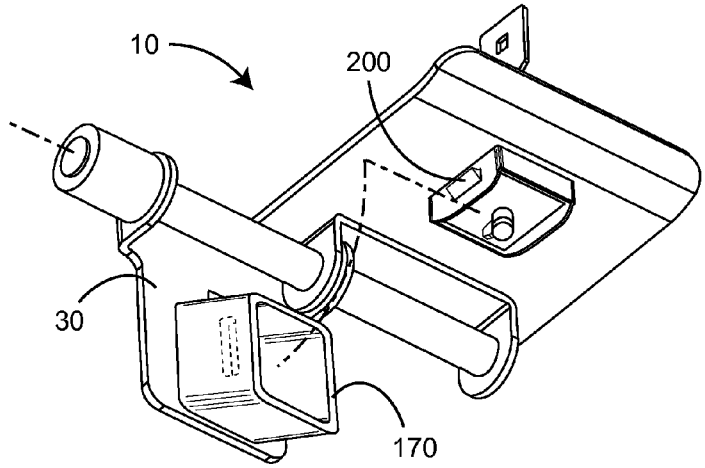
FIG. 10 is a perspective view of yet another alternate embodiment in the open and retracted position.
Figure 9:
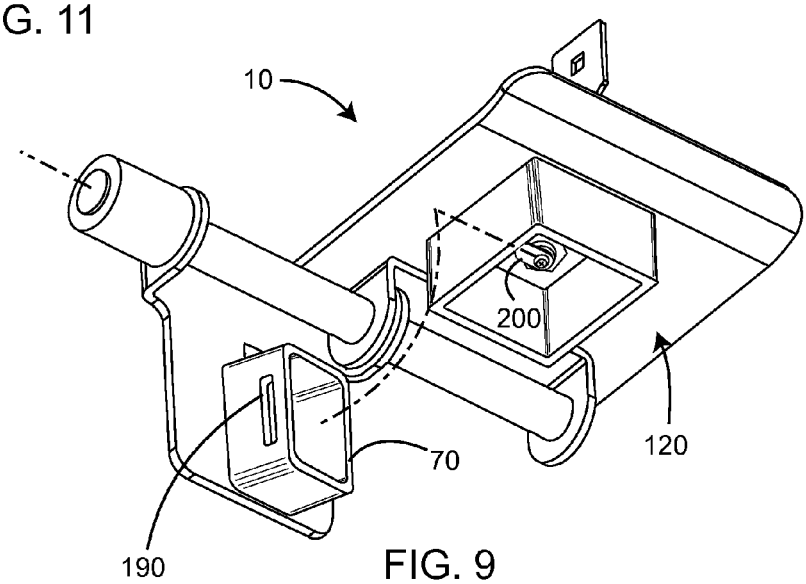
FIG. 9 is a perspective view of another alternate embodiment in the open and retracted position.

The backing plate 30 preferably includes a pair of opposed risers 50, each of which has an aperture 60 therein. The backing plate 30 further includes a lock socket 70 (FIGS. 4, 9 and 10). In one embodiment, at least one of the backing plate apertures 140 is within the lock socket 70.

Figure 6:
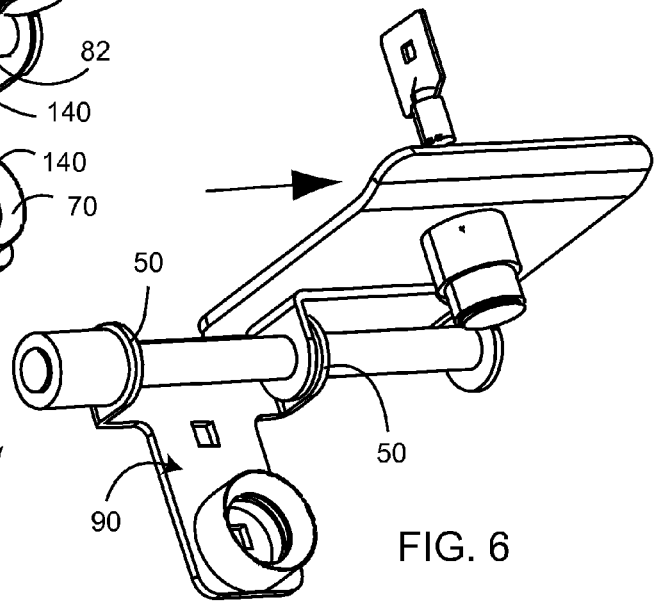
FIG. 6 is a perspective view of the embodiment of FIG. 4, illustrated in a retracted position.
Figure 7:
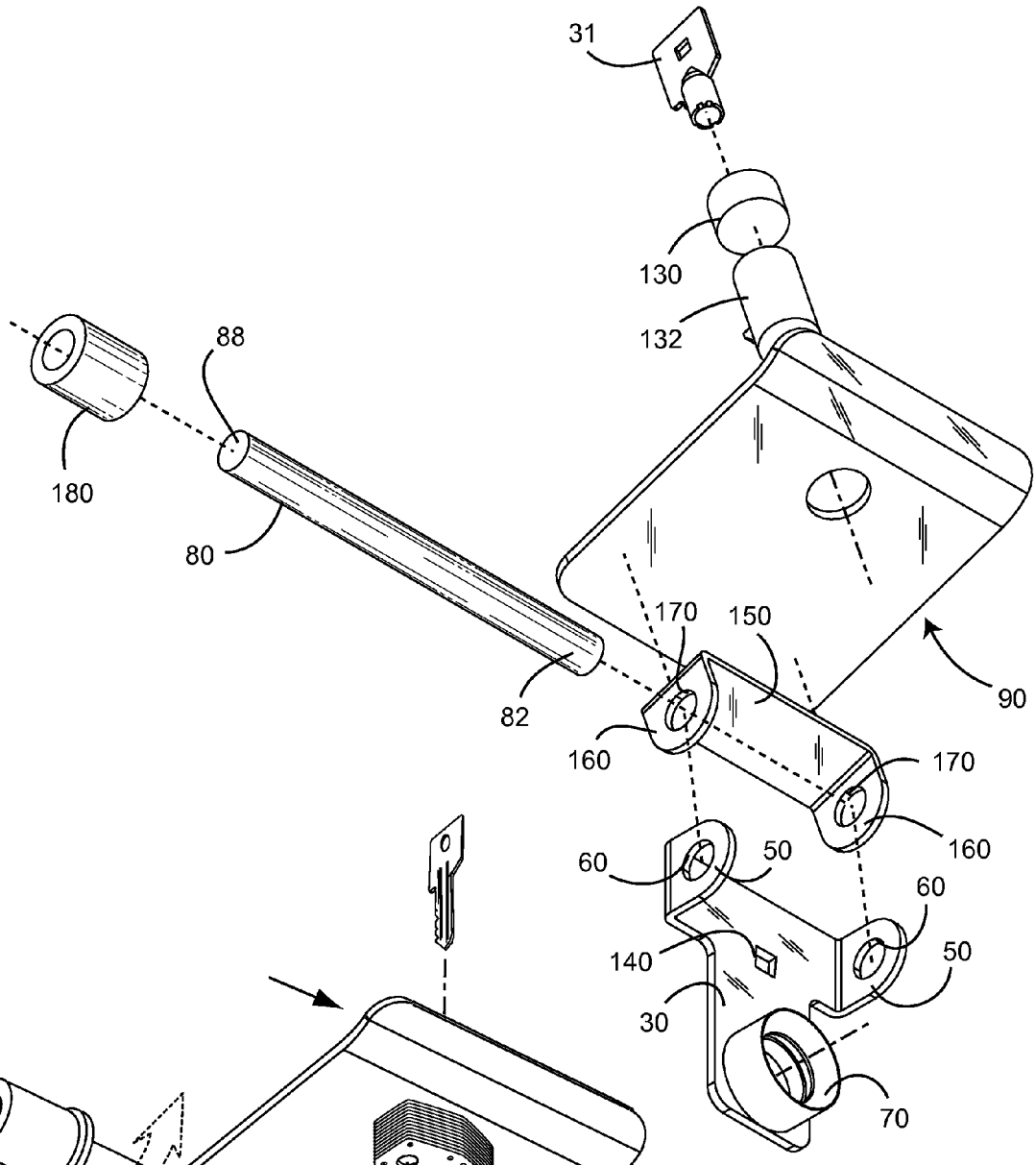
FIG. 7 is an exploded perspective view of the embodiment of FIG. 1.

A rigid slide bolt 80 has a distal end 88 and a proximal end 82. The slide bolt 80 is slidably and pivotally captured within the apertures 60 of each riser 50 and further includes fixed thereto a lock cover 90. The slide bolt 80 and the lock cover 90 are slidable between an extended position 100 (FIG. 4) and a retracted position 110 (FIG. 6). The distance D1 (FIG. 4) between the extended position 100 and the retracted position 110 is substantially defined by the distance between each riser 50 of the backing plate 30. The slide bolt 80 may be made from a rigid steel rod stock or other suitably strong material.

The lock cover 90 includes a lock mechanism 120 adapted to selectively and lockingly engage the lock socket 70 of the backing plate 30 when the slide bolt 80 is in the extended position 100, wherein the lock cover 90 substantially covers the backing plate 30. In one embodiment, the lock mechanism 120 is a key lock mechanism 130 that includes a key 131, a tumbler 132, and a key hole 133, such that the key 131 is rotatable in the key hole 133 to turn the tumbler 132 to disengage the lock mechanism 120 from the lock socket 70. The lock cover 90 may be made from a rigid steel or other suitably strong material.

Figure 12:
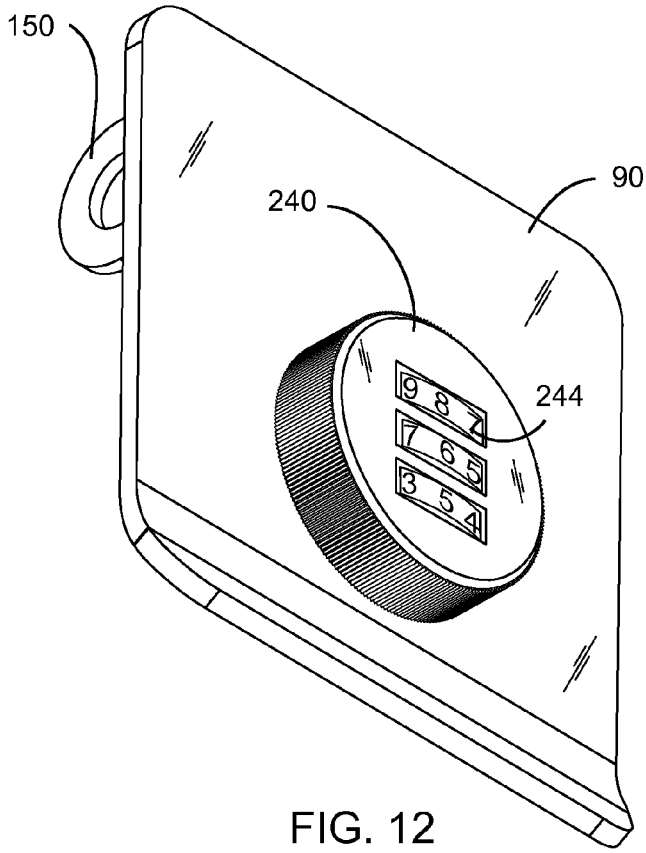
FIG. 12 is a front perspective view of an embodiment having a combination dial mechanism.
Figure 13:
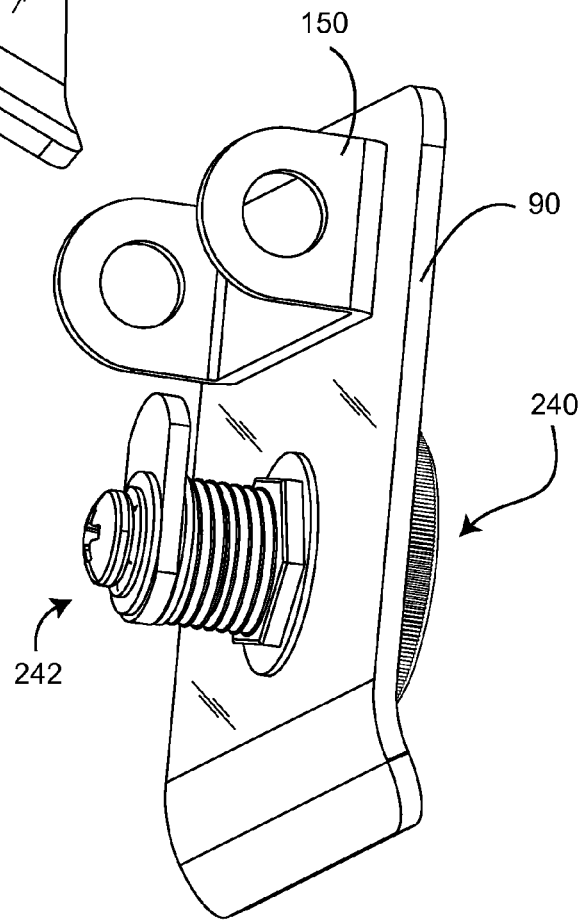
FIG. 13 is a rear perspective view of the embodiment of FIG. 12.

In an alternate embodiment of the invention, the lock socket 70 includes a lateral aperture 190 (FIGS. 9 and 10) for receiving a lock mechanism bolt 200 of the lock mechanism 120. The lock mechanism bolt 200 is selectively positionable by the key 131 to engage or disengage the lateral aperture 190. Such a lock mechanism bolt 200 may be linearly extended or retracted by the lock mechanism 120 to engage the lateral aperture 190, or may be rotationally engaged or disengaged (FIG. 9) from the lateral aperture 190. In one embodiment, the lock mechanism 120 includes a combination dial mechanism 240 (FIGS. 12 and 13) that includes a plurality of numerical dials 244 that must be aligned in with a particular combination to allow the combination dial mechanism to turn a combination lock mechanism bolt 242.

Figure 8:
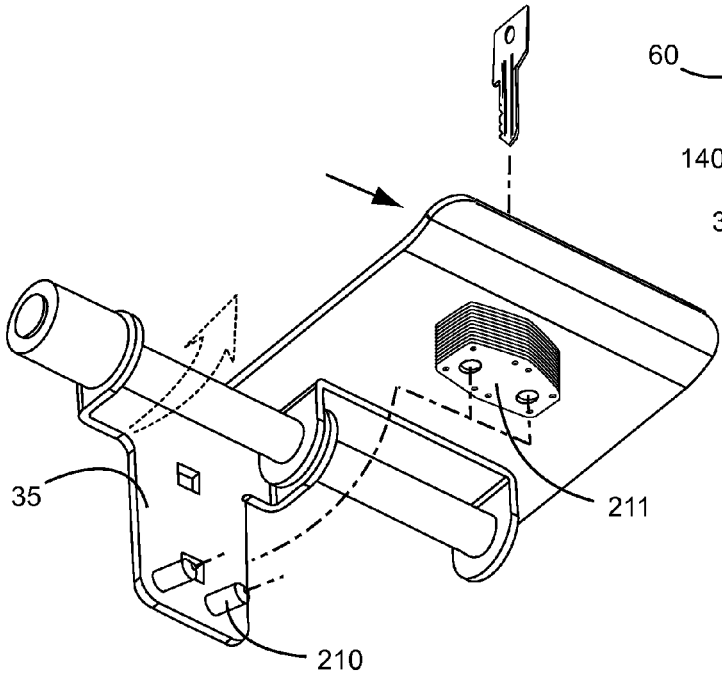
FIG. 8 is a perspective view of an alternate embodiment in the open and retracted position.
Figure 11:
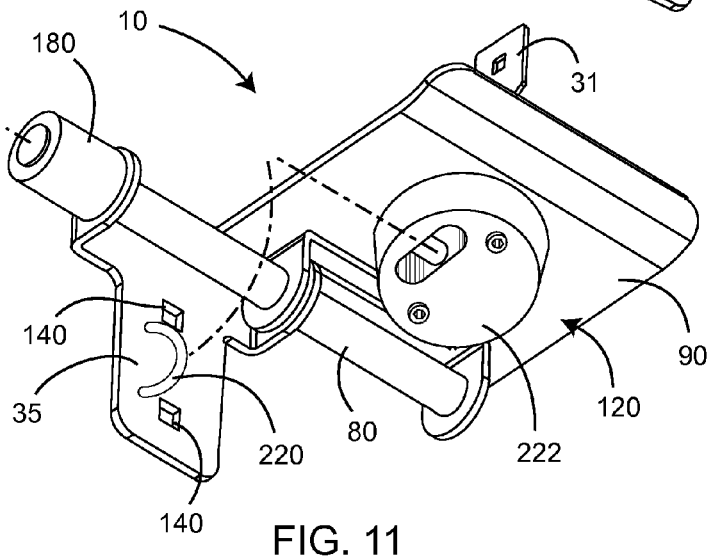
FIG. 11 is a perspective view of yet another alternate embodiment in the open and retracted position.

In yet another embodiment, the lock socket 70 is replaced with at least one lock prong 210 (FIG. 8). In such an embodiment the lock mechanism 120 is essentially a padlock mechanism 211. In an alternate embodiment, the at least one lock prong 210 is a lock prong loop 220 (FIG. 11), and the lock mechanism 120 is a puck lock mechanism 222.

In one embodiment, the lock cover 90 is fixed to the slide bolt 80 with a locking plate bracket 150 (FIG. 7) that has a pair of opposed risers 160, each of which includes an aperture 170 therethrough and is adapted to fixedly receive the slide bolt 80 therein. The slide bolt 80 may be welded or otherwise permanently fixed with each riser of the locking plate bracket 150.

In use, with the slide bolt 80 in the retracted position 110 the door 20 is free to swing clear of the frame 25, and with the slide bolt 80 in the extended position 100 and the distal end 88 thereof engaged with the slide bolt aperture 26 of the frame 25, the lock cover 90 may be pivoted so that the lock mechanism 120 engages the lock socket 70 to lock the door 20 to the frame 25.

In one embodiment, a bushing 180 is rotationally fixed about the distal end 88 of the slide bolt 80, the bushing being positioned between the frame 25 and the backing plate 30 when the slide bolt 80 is in the extended position 100 and engaged with the frame 25. As such, force applied to the bushing 180, such as by a cutting blade 18 or the like, causes the bushing 180 to rotate about the slide bolt 80, inhibiting the slide bolt 80 from being cut or otherwise vandalized.

While a particular form of the invention has been illustrated and described, it will be apparent that various modifications can be made without departing from the spirit and any particular door or space available, or may be decorative in nature. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A slide bolt lock for locking a door to a frame, the frame having a slide bolt aperture, the lock comprising:

a backing plate having a door mount adapted to fix the backing plate to the door, the backing plate further include a pair of opposed risers each having an aperture therein and a lock socket, the door mount being a pair of backing plate apertures through which a mechanical fastener may be inserted to secure the backing plate to the door, one of the backing plate apertures being within the lock socket;

a slide bolt having a distal end and a proximal end, the slide bolt slidably and pivotally captured within the aperture of each riser and further including fixed thereto a lock cover, the slide bolt and lock cover slidable between an extended position and a retracted position, the distance therebetween defined by the distance between each riser of the backing plate, the lock cover including a lock mechanism adapted to selectively engage the lock socket of the backing plate when the slide bolt is in the extended position, the lock cover substantially covering the backing plate when in the extended position;

whereby with the slide bolt in the retracted position the door is free to swing clear of the frame, and with the slide bolt in the extended position and the distal end thereof engaged with the slide bolt aperture of the frame, the lock cover may be pivoted so that the lock mechanism engages the lock socket to lock the door to the frame.

2. The slide bolt lock of claim 1 wherein the lock mechanism is a key lock mechanism that includes a key and a tumbler with a key hole, the key being rotatable to turn the tumbler to disengage the lock mechanism from the lock socket.

3. A slide bolt lock for locking a door to a frame, the frame having a slide bolt aperture, the lock comprising:

a backing plate having a door mount adapted to fix the backing plate to the door, the backing plate further include a pair of opposed risers each having an aperture therein and a lock socket;

a slide bolt having a distal end and a proximal end, the slide bolt slidably and pivotally captured within the aperture of each riser and further including fixed thereto a lock cover, the slide bolt and lock cover slidable between an extended position and a retracted position, the distance therebetween defined by the distance between each riser of the backing plate, the lock cover including a lock mechanism adapted to selectively engage the lock socket of the backing plate when the slide bolt is in the extended position, the lock cover substantially covering the backing plate when in the extended position, the lock cover being fixed to the slide bolt with a locking plate bracket having a pair of opposed risers, each riser including an aperture adapted to fixedly receive the slide bolt therein;

whereby with the slide bolt in the retracted position the door is free to swing clear of the frame, and with the slide bolt in the extended position and the distal end thereof engaged with the slide bolt aperture of the frame, the lock cover may be pivoted so that the lock mechanism engages the lock socket to lock the door to the frame.

4. The slide bolt lock of claim 3 wherein the slide bolt is welded to each riser of the locking plate bracket.

5. The slide bolt lock of claim 1 further including a bushing rotationally fixed about the distal end of the slide bolt, the bushing positioned between the frame and the backing plate when the slide bolt is in the extended position and engaged with the frame, whereby force applied to the bushing by a cutting blade causes the bushing to rotate about the slide bolt.

6. The slide bolt lock of claim 1 wherein the lock socket includes a lateral aperture for receiving a lock mechanism bolt of the lock mechanism, the lock mechanism bolt being selectively positionable by a key to engage or disengage the lateral aperture.

7. The slide bolt lock of claim 6 wherein the lock mechanism bolt is linearly extended and retracted from the lock mechanism.

8. The slide bolt lock of claim 6 wherein the lock mechanism bolt is rotationally engaged and disengaged from the lateral aperture.

9. The slide bolt lock of claim 8 wherein the lock mechanism includes a combination dial mechanism.

10. A slide bolt lock for locking a door to a frame, the frame having a slide bolt aperture, the lock comprising:

a backing plate having a door mount adapted to fix the backing plate to the door, the backing plate further include a pair of opposed risers each having an aperture therein and at least one lock prong;

a slide bolt having a distal end and a proximal end, the slide bolt slidably and pivotally captured within the aperture of each riser and further including fixed thereto a lock cover, the slide bolt and lock cover slidable between an extended position and a retracted position, the distance therebetween defined by the distance between each riser of the backing plate, the lock cover including a lock mechanism adapted to selectively and lockingly engage the at least one lock prong of the backing plate when the slide bolt is in the extended position, the lock cover substantially covering the backing plate when in the extended position, the lock cover being fixed to the slide bolt with a locking plate bracket having a pair of opposed risers, each riser including an aperture adapted to fixedly receive the slide bolt therein;

whereby with the slide bolt in the retracted position the door is free to swing clear of the frame, and with the slide bolt in the extended position and the distal end thereof engaged with the slide bolt aperture of the frame, the lock cover may be pivoted so that the lock mechanism lockingly engages the at least one lock prong to lock the door to the frame.

11. The slide bolt lock of claim 10 wherein the lock mechanism is a key lock mechanism that includes a key and a tumbler with a key hole, the key being rotatable to turn the tumbler to disengage the lock mechanism from the at least one lock prong.

12. The slide bolt lock of claim 10 wherein the door mount is a pair of backing plate apertures through which a mechanical fastener may be inserted to secure the backing plate to the door.

13. The slide bolt lock of claim 10 wherein the slide bolt is welded to each riser of the locking plate bracket.

14. The slide bolt lock of claim 10 further including a bushing rotationally fixed about the distal end of the slide bolt, the bushing positioned between the frame and the backing plate when the slide bolt is in the extended position and engaged with the frame, whereby force applied to the bushing by a cutting blade causes the bushing to rotate about the slide bolt.

15. The slide bolt lock of claim 10 wherein the at least one lock prong is a lock prong loop, and wherein the lock mechanism includes a lock bolt that selectively engages the lock prong loop.

16. The slide bolt lock of claim 10 wherein the lock mechanism includes a combination dial mechanism.

* * * * *